US010814623B2

(12) United States Patent
Kasai et al.

(10) Patent No.: US 10,814,623 B2
(45) Date of Patent: Oct. 27, 2020

(54) ELEMENT SUBSTRATE AND LIQUID EJECTION HEAD

(71) Applicant: CANON KABUSHIKI KAISHA, Tokyo (JP)

(72) Inventors: Ryo Kasai, Tokyo (JP); Nobuyuki Hirayama, Fujisawa (JP); Masataka Sakurai, Kawasaki (JP); Kengo Umeda, Tokyo (JP); Hidenori Yamato, Tokyo (JP); Makoto Takagi, Yokohama (JP); Tatsuhito Goden, Machida (JP); Sadayoshi Sakuma, Oita (JP); Nobuyuki Suzuki, Oita (JP); Toru Eto, Oita (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 14 days.

(21) Appl. No.: 16/019,714

(22) Filed: Jun. 27, 2018

(65) Prior Publication Data

US 2018/0370233 A1 Dec. 27, 2018

Related U.S. Application Data

(63) Continuation of application No. 15/000,544, filed on Jan. 19, 2016, now Pat. No. 10,035,346.

(30) Foreign Application Priority Data

Jan. 27, 2015 (JP) ..... 2015-013197
Nov. 30, 2015 (JP) ..... 2015-233689

(51) Int. Cl.
*B41J 2/14* (2006.01)

(52) U.S. Cl.
CPC ..... *B41J 2/14072* (2013.01); *B41J 2/14129* (2013.01); *B41J 2202/03* (2013.01); *B41J 2202/11* (2013.01); *B41J 2202/18* (2013.01)

(58) Field of Classification Search
CPC ..... B41J 2/14072; B41J 2/14129; B41J 2202/11; B41J 2202/03; B41J 2202/18
See application file for complete search history.

(56) References Cited

U.S. PATENT DOCUMENTS 5,774,147 A 6/1998 Saito et al.
6,382,782 B1 5/2002 Anagnostopoulos et al.
(Continued)

FOREIGN PATENT DOCUMENTS

CN 1863676 A 11/2006
CN 1919605 A 2/2007
(Continued)

OTHER PUBLICATIONS

Office Action dated Aug. 23, 2019, in counterpart application IN 201644002494 (9 pages).
(Continued)

*Primary Examiner* — Justin Seo
(74) *Attorney, Agent, or Firm* — Venable LLP

(57) ABSTRACT

An element substrate of a liquid ejection head includes: a base material; an insulating film positioned on the base material; a heating resistance element for generating heat energy for ejecting a liquid; a protective film for covering the heating resistance element; a first electrical wiring layer arranged in the insulating film, for supplying a current to the heating resistance element; a second electrical wiring layer arranged on a layer different from the first electrical wiring layer in the insulating film, for supplying a current to the heating resistance element; and at least one connecting member extending into the insulating film to connect the first electrical wiring layer and the heating resistance element, for causing the current to flow in a first direction, the heating resistance element including a connecting region, extending in a second direction intersecting the first direc-
(Continued)

tion, to which the at least one connecting member is connected.

19 Claims, 12 Drawing Sheets

(56) References Cited

U.S. PATENT DOCUMENTS

| | | | |
|---|---|---|---|
| 8,445,298 | B2 | 5/2013 | Takeuchi et al. |
| 9,120,310 | B2 | 9/2015 | Ishida et al. |
| 2007/0046730 | A1 | 3/2007 | Min et al. |
| 2007/0153064 | A1 | 7/2007 | Miyamoto et al. |
| 2008/0309731 | A1 | 12/2008 | Saito et al. |
| 2010/0149280 | A1 | 6/2010 | Ibe et al. |
| 2010/0245486 | A1 | 9/2010 | Ishida et al. |
| 2011/0059558 | A1 | 3/2011 | Takeuchi et al. |
| 2015/0290935 | A1 | 10/2015 | Tamatsukuri et al. |

FOREIGN PATENT DOCUMENTS

| | | | |
|---|---|---|---|
| CN | 101844442 | A | 9/2010 |
| CN | 102009527 | A | 4/2011 |
| EP | 0 924 080 | A2 | 6/1999 |
| JP | 2-125743 | A | 5/1990 |
| JP | 4-320849 | A | 11/1992 |

OTHER PUBLICATIONS

Office Action dated May 31, 2019, in Chinese counterpart application 201810154140.2 (16 pages).

European search report issued in corresponding application No. 16152512.6 dated Oct. 24, 2016—11 pages.

Taiwanese Office Action dated Dec. 13, 2016, issued in counterpart TW application 105100394 (11 pages).

Russian Office Action dated Jul. 20, 2017, issued in counterpart RU application 2016102322 (12 pages including English translation).

Chinese Office Action dated Jul. 27, 2017, issued in counterpart CN application 201610045927.6 (28 pages including English translation).

ELEMENT SUBSTRATE AND LIQUID EJECTION HEAD

The present application is a continuation of U.S. patent application Ser. No. 15/000,544, filed Jan. 19, 2016, which claims priority to JP 2015-233689, filed Nov. 30, 2015, and JP 2015-013197, filed Jan. 27, 2015, the entire disclosure of each of which is incorporated by reference herein.

BACKGROUND OF THE INVENTION

Field of the Invention

The present invention relates to an element substrate of a liquid ejection head, in particular, a connecting structure of a heating resistance element and an electrical wiring.

Description of the Related Art

As an information output device in a word processor, a personal computer, a facsimile, and the like, a recording device configured to record information on a desired character or image on a sheet-like recording medium, such as paper or a film, is commonly and widely used. In Japanese Patent Application Laid-Open No. H04-320849, there is described a liquid ejection head in which a heating resistance element is used. A pair of electrical wirings is connected to the heating resistance element that is arranged on a substrate. A portion of the heating resistance element that is between the pair of electrical wirings defines an actual region of the heating resistance element. The electrical wirings are arranged on a front surface of the heating resistance element when viewed from the substrate, namely, on a surface of the heating resistance element on an ejection orifice side. The end portions of the electrical wirings have a tapered shape. In order to protect the electrical wirings and the heating resistance element from a liquid, the electrical wirings and the heating resistance element are covered by a protective film. Film boiling of the liquid, such as an ink, occurs by applying a current to the heating resistance element from the electrical wirings, which causes the heating resistance element to generate heat. The liquid is ejected from the ejection orifice as an air bubble produced by the film boiling, to thereby perform recording. With such a liquid ejection head, it is easy to densely arrange multiple ejection orifices and heating resistance elements, to thereby enable a high-resolution recording image to be obtained.

With the increase in the number of the ejection orifices and ejection speed in recent years, the power consumption of the liquid ejection head has been increasing. In order to suppress the power consumption of the liquid ejection head, it is important for the heat of the heating resistance element to be efficiently transmitted to the liquid. In order to efficiently transmit the heat, it is effective to reduce the thickness of the protective film covering the heating resistance element. Meanwhile, a certain thickness is required in order to ensure the protective performance of the protective film for the electrical wirings and the heating resistance element. In particular, as the electrical wirings are thicker than the heating resistance element, the protective film needs to be thick enough to reliably cover a step formed at a boundary portion between the electrical wirings and the heating resistance element. In the liquid ejection head described in Japanese Patent Application Laid-Open No. H04-320849, the end portions of the electrical wirings have a tapered shape, and hence the coverage of the protective film is improved, with the result that the thickness of the protective film may be reduced. However, in order to realize an even thinner protective film, the taper angle of the electrical wirings needs to be reduced. However, when the taper angle is reduced, it is difficult to ensure the dimensional accuracy of the effective length of the heating resistance element defined by the end portions of the electrical wirings. When the dimension of the effective length of the heating resistance element varies, the heat-generation properties among the heating resistance elements fluctuate. Consequently, it becomes difficult to achieve high quality printing.

SUMMARY OF THE INVENTION

According to one embodiment of the present invention, there is provided an element substrate of a liquid ejection head, the element substrate including: a base material; an insulating film positioned on the base material; a heating resistance element configured to generate heat energy for ejecting a liquid; a protective film configured to cover the heating resistance element; a first electrical wiring layer, which is arranged in the insulating film, and is configured to supply a current to the heating resistance element; a second electrical wiring layer, which is arranged on a layer different from the first electrical wiring layer in the insulating film, and is configured to supply a current to the heating resistance element; and at least one connecting member configured to extend into the insulating film to connect the first electrical wiring layer and the heating resistance element, the heating resistance element being configured to cause the current to flow in a first direction, the heating resistance element comprising a connecting region to which the at least one connecting member is connected, the connecting region extending in a second direction intersecting the first direction.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

Figure 1A:
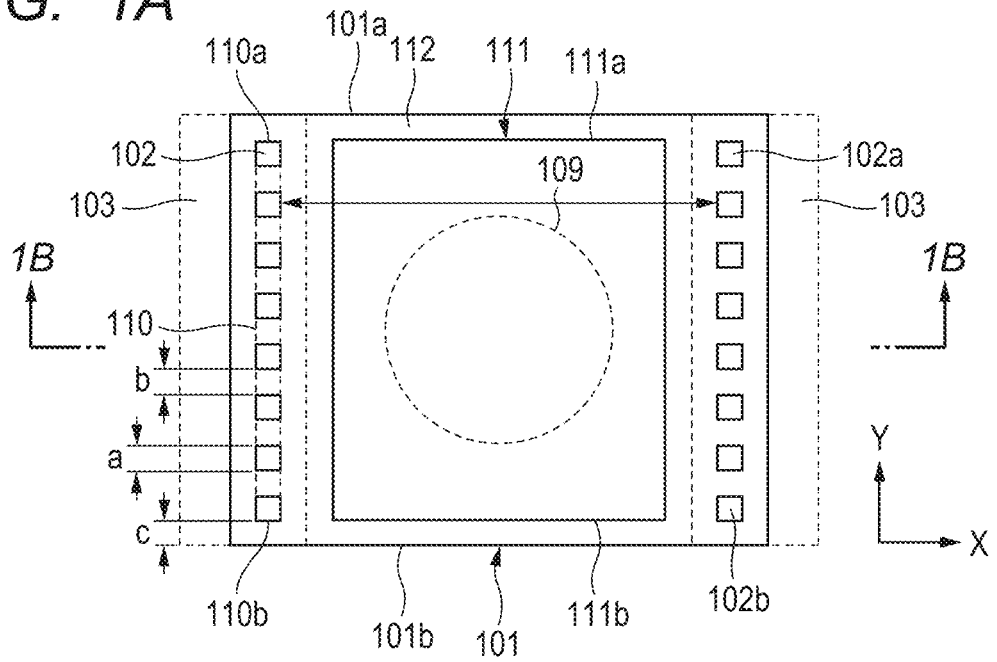
FIG. 1A is a plan view near a heating resistance element according to a first embodiment of the present invention.
Figure 1B:
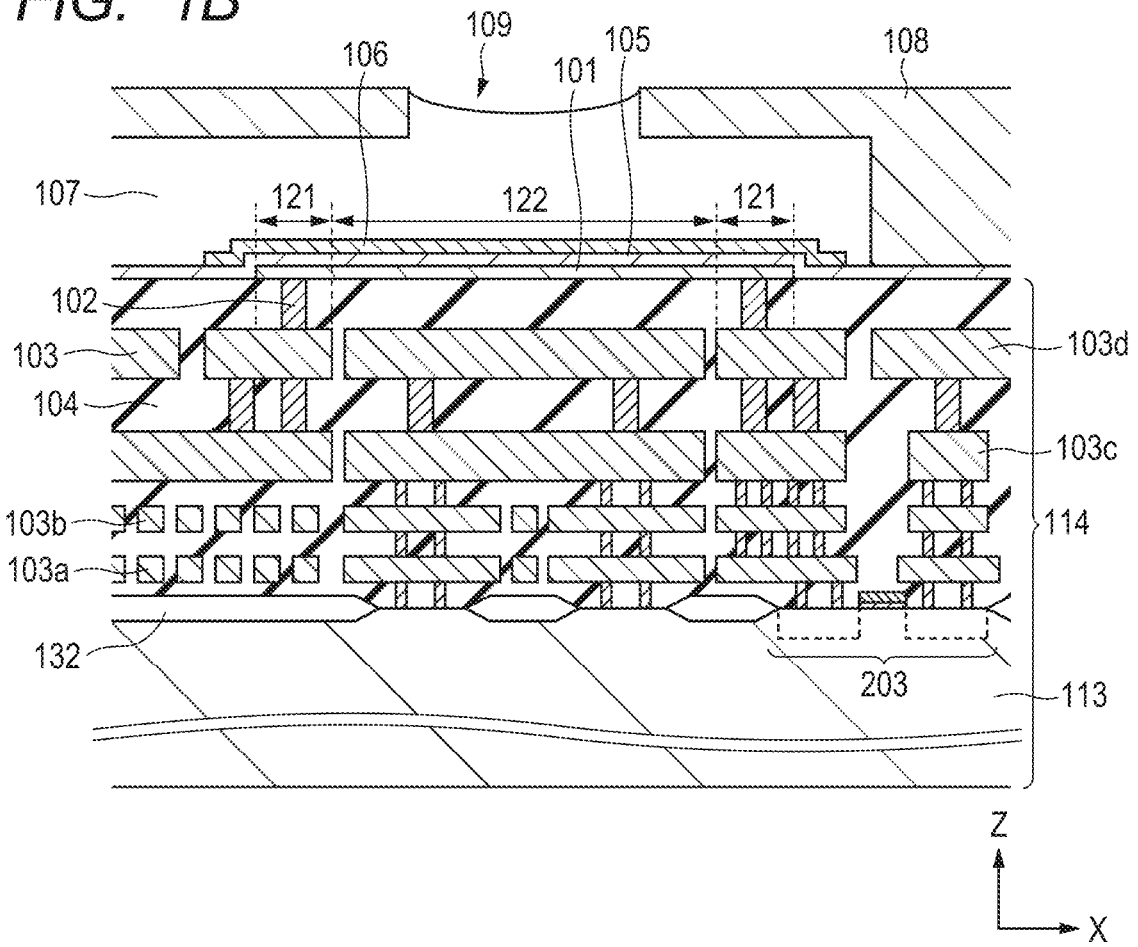
FIG. 1B is a cross-sectional view taken along the line 1B-1B in FIG. 1A.
Figure 15:
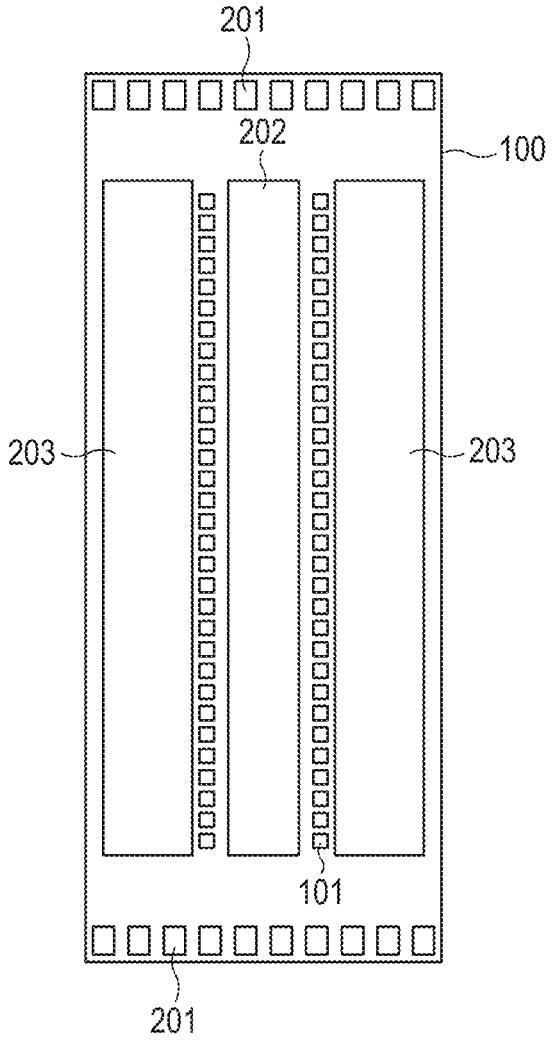
FIG. 15 is a plan view of an element substrate of a liquid ejection head.

Now, with reference to the drawings, an element substrate of a liquid ejection head according to a first embodiment of the present invention is described. FIG. 15 is a plan view of an element substrate 100 of a liquid ejection head. In FIG. 15, an ejection orifice forming member is not shown. FIG. 1A and FIG. 1B are enlarged schematic views of a surrounding region of one of the heating resistance elements illustrated in FIG. 15. FIG. 1A is a plan view near the heating resistance element, and FIG. 1B is a cross-sectional view taken along the line 1B-1B in FIG. 1A. In the following description, the direction in which current flows toward the heating resistance element is referred to as a first direction X or an X direction, and the direction orthogonal to the first direction X is referred to as a second direction Y or a Y direction. The Y direction is the direction in which the heating resistance elements and the ejection orifices are arranged. The direction orthogonal to the X direction and the Y direction is referred to as a Z direction. The Z direction, which is the direction orthogonal to an ejection orifice forming surface, is the direction in which the liquid is ejected. In the embodiments of the present invention described below, an inkjet printer head configured to eject ink for printing characters is described. However, the present invention may be applied to any liquid ejection head configured to eject a liquid.

The element substrate 100 (FIG. 15) of the liquid ejection head includes a substrate 114 and an ejection orifice forming member 108. The substrate 114 includes a base material 113 formed of silicon and an insulating film 104 formed on the base material 113. A heating resistance element 101 configured to generate heat energy for ejecting the liquid, a protective film 105, and an anti-cavitation film 106 are arranged on the substrate 114. The insulating film 104 is formed of an insulator, such as silicon dioxide. As illustrated in FIG. 15, an ink supply port 202 extending in a longitudinal direction (matching the Y direction in this embodiment) is arranged in a center portion of the element substrate 100. A plurality of heating resistance elements 101 are arranged in lines on both sides of the ink supply port 202. The heating resistance elements 101 are formed of a tantalum compound, such as tantalum silicon nitride. The thickness (Z direction dimension) of the heating resistance elements 101 is from about 0.01 μm to about 0.5 μm, which is considerably smaller than the thickness of an electrical wiring 103, which is described below. The ejection orifice forming member 108 is arranged on a surface on which the heating resistance elements 101 of the substrate 114 are formed. The ejection orifice forming member 108 includes ejection orifices 109 corresponding to respective heating resistance elements 101. Together with the substrate 114, the ejection orifice forming member 108 forms a pressure chamber 107 for each ejection orifice 109. The pressure chambers 107 are in communication with the ink supply port 202. Ink supplied from the ink supply port 202 is introduced into the pressure chambers 107.

As illustrated in FIG. 15, drive circuits 203 configured to drive the heating resistance elements 101 are arranged on both sides of the ink supply port 202 of the element substrate 100. The drive circuits 203 are connected to electrode pads 201 arranged at both ends of the substrate 114 in the longitudinal direction Y. The drive circuits 203 are configured to generate a drive current of the heating resistance elements 101 based on a recording signal supplied from the outside of the liquid ejection head via the electrode pads 201. Electrical wirings 103 for supplying the current to the heating resistance elements 101 extend into the insulating film 104 arranged on the substrate 114. The electrical wirings 103 are arranged so as to be embedded in the insulating film 104. The electrical wirings 103 electrically connect the drive circuits 203 and the heating resistance elements 101 via connecting members 102, which are described later. The electrical wirings 103 are formed of aluminum and have a thickness (Z direction dimension) of from about 0.6 μm to about 1.2 μm. The supplied current causes the heating resistance elements 101 to generate heat, with the result that the heating resistance elements 101 becomes hot. The hot heating resistance elements 101 heat the ink in the pressure chambers 107, causing air bubbles to form. Ink in the vicinity of the ejection orifices 109 is ejected from the ejection orifices 109 by the air bubbles to thereby perform recording.

The heating resistance elements 101 are covered by the protective film 105. The protective film 105 is formed of silicon nitride, and has a thickness of from about 0.15 μm to about 0.3 μm. The protective film 105 may also be formed of silicon dioxide or silicon carbide. The protective film 105 is covered by the anti-cavitation film 106. The anti-cavitation film 106 is formed of tantalum, and has a thickness of from about 0.2 μm to about 0.3 μm.

A plurality of connecting members 102 for connecting the electrical wirings 103 and the heating resistance elements 101 are arranged in the insulating film 104. The plurality of connecting members 102 extending in the thickness direction (Z direction) are positioned so that there is a gap between adjacent connecting members 102 in the second direction Y. The connecting members 102 connect the electrical wirings 103 and the heating resistance elements 101 in the vicinity of the end portions on both sides of the heating resistance elements 101 in the X direction. Therefore, the current flows through the heating resistance elements 101 in the first direction X. Each of the plurality of connecting members 102 is arranged in the vicinity of the end portion of each side of the heating resistance elements 101 in the X direction. Each heating resistance element 101 includes, at one end side of the heating resistance element 101 and at another end side of the heating resistance element 101, respectively, a connecting region 110 to which the plurality of connecting members 102 are connected. The connecting members 102 are a plug extending in the Z direction from near the end portions of the electrical wirings 103. In this embodiment, the connecting members 102 have a roughly square-shaped cross-section. However, the connecting members 102 are not limited to having a square shape and may have a rectangular shape. The connecting members 102 may have rounded corners, and may have some other shape, such as a round shape or an oval shape. In this case, the connecting members 102 are formed of tungsten. However, the connecting members 102 may be formed of any one of titanium, platinum, cobalt, nickel, molybdenum, tantalum, or silicon, or of a compound of these. The connecting members 102 may be integrally formed with the electrical wirings 103. In other words, the connecting members 102 may be formed integrated with the electrical wirings 103 by cutting a part of the electrical wirings 103 in the thickness direction.

The connecting regions 110 are the minimum rectangular region including all the connecting members 102 (external connecting region). The connecting regions 110 extend in the second direction Y, which is orthogonal to the first direction X. However, the second direction is not necessarily orthogonal to the first direction X. In other words, the connecting regions 110 may extend in a second direction that intersects the first direction X in a diagonal direction. The region in the heating resistance elements 101 actually contributing in ink foaming is called a foaming region 111. The foaming region 111 is nearer the inner side of the heating resistance element 101 than the outer periphery of the heating resistance element 101. A region between the foaming region 111 and the outer periphery of the heating resistance element 101 (hereinafter referred to as a "frame region 112") is a region that does not contribute to ink foaming. Although heat is also generated in the frame region 112 when electricity is supplied, a large amount of that heat is radiated to the surroundings, and hence the ink is not foamed. The dimensions of the foaming region 111 in the X direction and in the Y direction are determined based on the structure of the surroundings of the heating resistance elements 101 and the thermal conductivity of the heating resistance elements 101. The connecting regions 110 are arranged on both sides of the frame region 112, adjacent to the foaming region 111 in the first direction X, and extending across a range including the entire length of the foaming region 111 in the second direction Y. In other words, when viewed from the first direction X, end portions 110*a* and 110*b* of both sides of the connecting regions 110 in the Y direction are closer to peripheral portions 101*a* and 101*b* of both sides of the heating resistance elements 101 in the Y direction than peripheral portions 111*a* and 111*b* of both sides of the foaming region 111 in the Y direction. As a result, the current density across the whole of the foaming region 111 is uniform.

As illustrated in FIG. 1B, the electrical wirings 103 are arranged in the insulating film 104, and are connected to the heating resistance elements 101 by the connecting members 102. Thus, the electrical connection to the heating resistance elements 101 is made from the back surface, and hence electrical wirings covering a front surface of the heating resistance elements 101 are not necessary. In a related-art configuration in which the electrical wirings are connected to the front surface of the heating resistance elements 101, electrical wirings having a thickness of from about 0.6 μm to about 1.2 μm are laminated on the heating resistance elements 101, and hence a comparatively thick protective film needs to be arranged in order to ensure good coverage of the steps that are about 0.6 μm to about 1.2 μm high. In contrast, in this embodiment, there is no need for electrical wirings to be arranged on the front surface of the heating resistance elements 101. The thickness of the heating resistance elements 101 is from about 0.01 μm to about 0.05 μm, and hence the steps are considerably smaller than in the related-art configuration. Therefore, because sufficient coverage can be ensured by the protective film 105 having a thickness of from about 0.15 μm to about 0.3 μm, the thickness of the protective film 105 can be reduced, which enables a great improvement in the thermal conductivity to the ink. As a result, power consumption can be reduced, and higher image quality can be obtained due to stable foaming. Further, improvements in the patterning accuracy and reliability of the anti-cavitation film 106, and improved adhesion properties of the ejection orifice forming member 108 to the substrate 114 and processing precision, can be expected. In addition, there are benefits not only in terms of improved image quality, but in manufacturing aspects as well.

Figure 3:
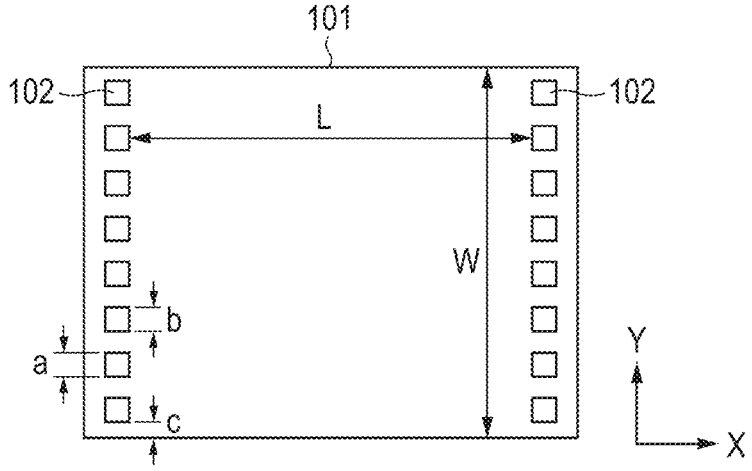
FIG. 3 is a plan view near a heating resistance element according to a second embodiment of the present invention.

The connection positions of the connecting members 102 to the heating resistance elements 101 define the actual length (effective length L) of the heating resistance elements 101 in the X direction (refer to FIG. 3). The effective length L of the heating resistance elements 101 is equal to the gap of the connecting regions 110 on both sides in the X direction. Increasing the dimensional accuracy of the effective length L of the heating resistance elements 101 enables the dimensional accuracy of the length of the foaming region 111 in the X direction to be increased. For a related-art liquid ejection head represented by the one described in Japanese Patent Application Laid-Open No. H04-320849, the shape of the heating resistance elements is typically formed by removing the electrical wirings 103 by wet etching, which means that it is difficult to improve the dimensional accuracy of the effective length L of the heating resistance elements 101. In contrast, in this embodiment, the connecting members 102 are formed by forming holes in the flat insulating film 104 by dry etching, and embedding the material of the connecting members 102 in the holes. Therefore, compared with the related-art configuration, the dimensional accuracy of the effective length L of the heating resistance elements 101 is relatively high. The heating resistance elements 101 can be formed by patterning a thin film of the heating resistance elements 101, which enables the dimensional accuracy of the width W of the heating resistance elements 101 in the Y direction to be increased. As a result of the improvement in the dimensional accuracy of the heating resistance elements 101, there is less unevenness in the foaming properties among the heating resistance elements 101. This not only allows the liquid ejection head to have better image quality, but extra energy that is supplied to take such unevenness into account does not need to be supplied, and hence power consumption can be reduced. Further, in the configuration according to the present invention, because the heating resistance element film is formed on a flat base layer even when the connecting members 102 are not embedded in holes but are directly connected to the electrical wirings 103 from the holes, highly reliable heating resistance elements can be formed.

In order to obtain more uniform ink ejection properties, foaming unevenness and resistance value unevenness need to be more accurate. Therefore, it is preferred that the base layer of the heating resistance elements 101 (lower portion region) be flat. Hitherto, it has been difficult to arrange a wiring pattern and the like directly beneath the heating resistance elements or in the vicinity thereof in a manner that avoids steps from being produced. With the configuration according to the present invention, the flatness of the electrical wirings 103 of each layer and the flatness of the base layer portion of the heating resistance elements 101 are increased by performing a treatment such as chemical mechanical planarization (CMP). As a result, as illustrated in FIG. 1B, an abutting surface of the connecting members 102 with the heating resistance elements 101 and an abutting surface of the insulating film 104 with the heating resistance elements 101 are arranged in the same plane. Thus, increasing the flatness of the base layer (lower portion region) of a heating resistance layer enables the electrical wirings 103 having a pattern for a signal wiring, a power supply wiring, and the like, to pass directly beneath the heating resistance elements 101 or in the vicinity thereof. Further, because a transistor may also be arranged in that region, the surface area of the element substrate 100 can be reduced, the cost of the liquid ejection head can be decreased, and the density of the ejection orifices 109 can be increased. In this embodiment, as illustrated in FIG. 1B, the drive circuits 203 and a field oxide film 132 are formed at a boundary region of the base material 113 formed of silicon with the insulating film 104.

The above-mentioned configuration allows multiple layers of the electrical wirings 103 to be formed while suppressing effects on the properties of the heating resistance elements 101. Thus, allocating a plurality of wiring layers for the electrical wirings 103 enables a great reduction in the power supply wiring resistance, improved power consumption, and more uniform supply of energy to the heating resistance elements 101. In FIG. 1B, the electrical wirings 103 are formed in a four layer configuration. Electrical wirings 103*a* and 103*b* on a lower layer side are allocated as signal wirings and logic power supply wirings (third electrical wiring layer and fourth electrical wiring layer) for driving the heating resistance elements 101. Further, electrical wirings 103*c* and 103*d* on an upper layer side are allocated as wirings for supplying current to the heating resistance elements 101. In this embodiment, a ground (GNDH) wiring 103*d* (first electrical wiring layer) and a power supply (VH) wiring 103*c* (second electrical wiring layer) are both so-called solid wiring. Thus, employing a configuration (solid wiring) in which a first wiring layer and a second wiring layer of the power supply system are arranged as wiring layers formed in different layers, and both wiring layers are arranged over the whole surface of the element substrate enables the wiring resistance to be reduced to a very small value while suppressing an increase in the size of the element substrate 100.

In this embodiment, the insulating film 104 includes four electrical wiring layers, the electrical wiring layers 103*c* and 103*d* for causing the current to flow toward the heating resistance elements 101, and the electrical wiring layers 103*a* and 103*b* acting as signal wirings and logic power supply wirings for driving the heating resistance elements. The electrical wiring layers 103*c* and 103*d* are arranged closer to the heating resistance elements than the electrical wiring layers 103*a* and 103*b*. It is preferred that those wirings be thick by taking into consideration the fact that thicker wirings are relatively more efficient. Conversely, the electrical wiring layers 103*a* and 103*b* are arranged closer to the drive circuits 203 than the electrical wiring layers 103*c* and 103*d*. It is preferred that the thickness of those wirings be relatively thinner.

As illustrated in FIG. 1B, the heating resistance elements 101 are divided in the first direction X into two electrode regions 121 each including a connecting region 110, and a center region 122 positioned between the two electrode regions 121. The two electrode regions 121 and the center region 122 have the same dimension in the second direction Y. Specifically, the heating resistance elements 101 have a rectangular flat shape in the X-Y plane. In this embodiment, a width a of the connecting members 102, a gap b of the connecting members 102, and an overlap width c of the heating resistance elements 101 are optimized based on such a shape of the heating resistance elements 101. In this case, the width a of the connecting members 102 is the width of the connecting members 102 in the Y direction, the gap b of the connecting members 102 is the gap in the second direction Y between adjacent connecting members 102, and the overlap width c is the distance between the connecting members 102 at both the ends and the peripheral portions 101*a* and 101*b* of the heating resistance elements 101.

It is desired that the arrangement of the connecting members 102 be determined based on the following formula.

$$W=(a_{min}\times n)+(b_{min}\times(n-1))+(c\times 2) \quad (1)$$

where $c<a_{min}+b_{min}+c_{min}$ is satisfied. Each of the symbols in Formula (1) is as illustrated in FIG. 1A. The terms $a_{min}$, $b_{min}$, and $c_{min}$, which represent the minimum dimension for the layout, depend on the performance of the manufacturing apparatus, such as deviation of the mask during patterning, etching deviation, and deviation of the connecting members 102. Formula (1) shows that the maximum number n of the connecting members 102 is arranged based on the width W of the heating resistance elements 101 in the Y direction. Any remaining width is allocated to the overlap width c.

In this embodiment, in each electrode region 121, the width a of each of the connecting members 102 is the same, each gap b is the same (the connecting members 102 are arranged at equidistant intervals), and each overlap width c of both sides in the Y direction is the same. Further, the width a and the gap b of the connecting members 102, and the overlap width c are the same for the two electrode regions 121 as well. More specifically, the connecting members 102 of the two electrode regions 121 are arranged in a symmetrical shape in the Y direction. A total of lengths a of n-number of connecting members 102 is 50% or less of the width W of the heating resistance elements 101 in the Y direction.

Figure 2:
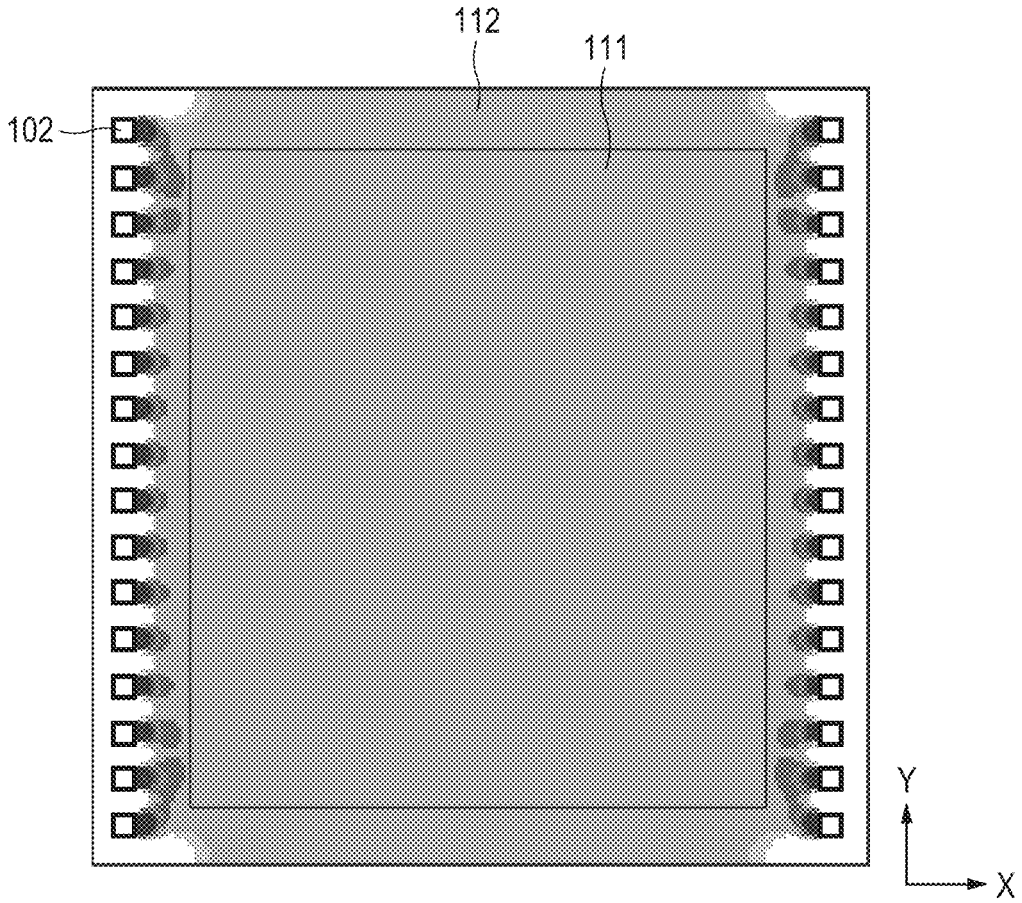
FIG. 2 is a diagram for illustrating an example of a current density distribution of the heating resistance element according to the first embodiment of the present invention.

In FIG. 2, a simulation result of a current density distribution in the heating resistance element 101 according to this embodiment is illustrated. The width of the frame region 112 is 2 μm. The simulation is performed by using a simulation program with integrated circuit emphasis (SPICE), in which the heating resistance elements 101 are modelled in a two-dimensional resistance mesh having units of 0.1 μm and the connecting members 102 are modelled in a three-dimensional mesh. The contours of the current density are shown in a range of from −5% to +5% based on the current density of the center portion of the foaming region 111 of the heating resistance element 101. The darker sections in FIG. 2 represent a high current density, and the lighter sections in FIG. 2 represent a low current density. The effective length L of the heating resistance element 101 is 20 μm, the width W of the heating resistance element 101 in the Y direction is 20 μm, the width a of the connecting members 102 is 0.6 μm, the gap b of the connecting members 102 is 0.6 μm, and the overlap width c is 0.7 μm. Each width a of the connecting members 102, each gap b of the connecting members 102, and each overlap width c of the heating resistance element 101 is the same. The number n of the connecting members 102 is 16 per side.

Based on the simulation result, an improvement in the uniformity of the current distribution of the foaming region 111 by arranging a plurality of the connecting members 102 in one line is confirmed. Although there is some unevenness in the current density of the frame region 112 in the vicinity of the connecting members 102, because this unevenness is outside the foaming region 111, there is no impact on ink foaming. The current concentrates on the side of the connecting members 102 that face the center of the heating resistance element 101. One possible method of preventing the current from concentrating may be to arrange the two lines of the connecting members 102 per side. However, because in such a case the current mainly flows through the line closer to the center of the heating resistance element 101, there is no benefit in arranging the connecting members 102 in two lines unless the sheet resistance of the heating resistance element 101 can be reduced to a very low level. Further, with the configuration in which the current flows through two lines of connecting members 102, it may be difficult define the effective length L of the heating resistance element 101. Therefore, it is desired that the plurality of connecting members 102 be arranged in one line.

Second Embodiment

In the first embodiment, as shown by the simulation result in FIG. 2, the current distribution at the four corners of the heating resistance elements 101 may decrease. Although this is not a problem when the width of the frame region 112 is as described in the first embodiment, depending on the film structure and the thermal conductivity of the heating resistance elements 101, when the width of the frame region 112 is reduced, the decrease in the current distribution at the four corners may be a problem. In a second embodiment of the present invention, in a configuration in which a plurality of the connecting members 102 are arranged in one line, the uniformity of the current distribution is increased.

The arrangement of the heating resistance element 101 and the connecting members 102 according to this embodiment is illustrated in FIG. 3. A relational expression is shown in Formula (2).

$$c=b/2 \tag{2}$$

Figure 4A:
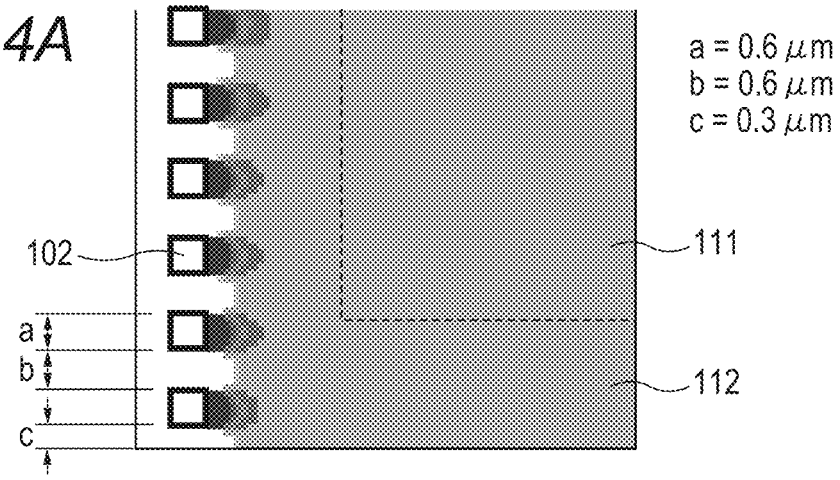
FIG. 4A, FIG. 4B, and FIG. 4C are diagrams for illustrating examples of current density distributions of the heating resistance element according to the second embodiment of the present invention.
Figure 4B:
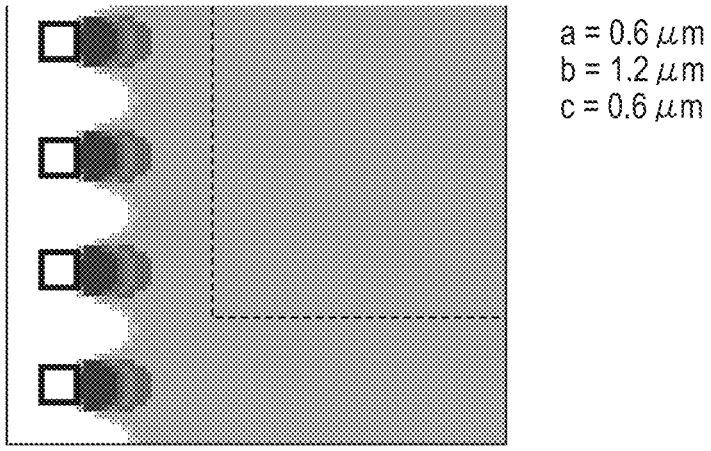
Figure 4C:
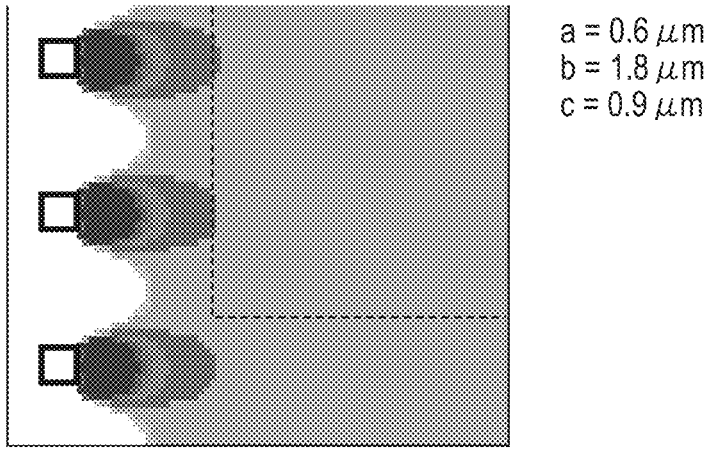

Each of the symbols in Formula (2) is the same as in the first embodiment, and as illustrated in FIGS. 1A and 1B. According to this embodiment, the current distribution around the connecting members 102 is essentially the same regardless of the position of the connecting members 102. In FIG. 4A to FIG. 4C, simulation results of the current density distributions of arrangements of the connecting members 102 satisfying Formula (2) are illustrated. The simulation conditions are the same as in the first embodiment. The illustrated positions are at the lower left of the heating resistance element 101. The width of the frame region 112 is 2 μm, which is the same as in the first embodiment. The gap b of the connecting members 102 is 0.6 μm in FIG. 4A, 1.2 μm in FIG. 4B, and 1.8 μm in FIG. 4C. When the conditions of Formula (2) are satisfied, the direction in which the current flows for the connecting members 102 at the end portions as well as for the connecting members 102 in the center portion is essentially the same, and hence a phenomenon such as that seen in FIG. 2, in which the current density at the four corners decreases, is less likely to occur. However, as the gap b of the connecting members 102 becomes wider and wider, a region in which the current distribution in the vicinity of the connecting members 102 is non-uniform widens. From around b=1.2 μm (not shown), that non-uniform region starts to spread to the foaming region 111. For this reason, it is desired that the gap b of the connecting members 102 be as small as possible. Specifically, it is desired that the gap b be 1.2 μm or less.

Ideally, Formula (2) and Formula (3) simultaneously hold for the width W of the heating resistance elements 101 in the Y direction.

$$W=(a_{min}\times n)+(b_{min}\times(n-1))+c\times 2 \tag{3}$$

Each of the symbols in Formula (3) is the same as in the first embodiment, and is as illustrated in FIGS. 1A and 1B. As in the first embodiment, the terms $a_{min}$ and $b_{min}$ represent the minimum dimension for the layout. When Formula (2) and Formula (3) are simultaneously satisfied, this means that the relationship c=b/2 is satisfied and that the connecting members 102 are arranged at the minimum possible dimension and with the minimum possible gap in terms of the manufacturing process.

In order to make the current distribution of the heating resistance elements 101 uniform with respect to the width of the center region 122 in the Y direction, which is determined based on the foaming properties of the heating resistance elements 101, it is desired that the width a or the gap b of the connecting members 102 be, while satisfying Formula (2) as far as possible, close to $a_{min}$ or $b_{min}$. When the width a of the connecting members 102 is widened, the region having a high current density widens. When the gap b of the connecting members 102 is widened, the region having a low current density widens. Therefore, when reducing the size of the region having a high current density, it is desired that the gap b of the connecting members 102 be widened, and when reducing the size of the region having a low current density, it is desired that the width a of the connecting members 102 be widened. The width a and the gap b of the connecting members 102 may both be widened. However, in all of the cases, in order to make the current distribution as uniform as possible, it is desired that the increase in $a_{min}$ or $b_{min}$ be equally allocated among all of the connecting members 102. Similar to the first embodiment, it is desired that the gap b of the connecting members 102 be 1.2 μm or less.

When it is difficult to equally allocate the increase in $a_{min}$ or $b_{min}$ among all of the connecting members 102, it is acceptable for the width a or the gap b of the connecting members 102 to be non-uniform. In this case, it is desired that b in Formula (2) be an average value of the gap b of the connecting members 102 based on one line. When Formula (2) cannot be satisfied, it is preferred that the overlap width c of both end portions be ¼ or more to less than one times the average gap of n-number of connecting members 102 in the second direction Y. In particular, in order to increase the current density at the four corners of the heating resistance elements 101, it is desired that the overlap width c of both end portions be ¼ or more to less than ½ the average gap.

Third Embodiment

The second embodiment is particularly effective when the overlap width c can be set to a small value. However, when the overlap width c is large, as illustrated in FIG. 4C, the region in which current density is non-uniform may spread as far as the foaming region 111. In a third embodiment of the present invention, not only a decrease in the current density at the four corners of the heating resistance elements 101 can be suppressed, but variation in the current distribution is less likely to occur, which may occur due to variation of the overlap width c and unevenness in the manufacturing positions of the connecting members 102.

Figure 5:
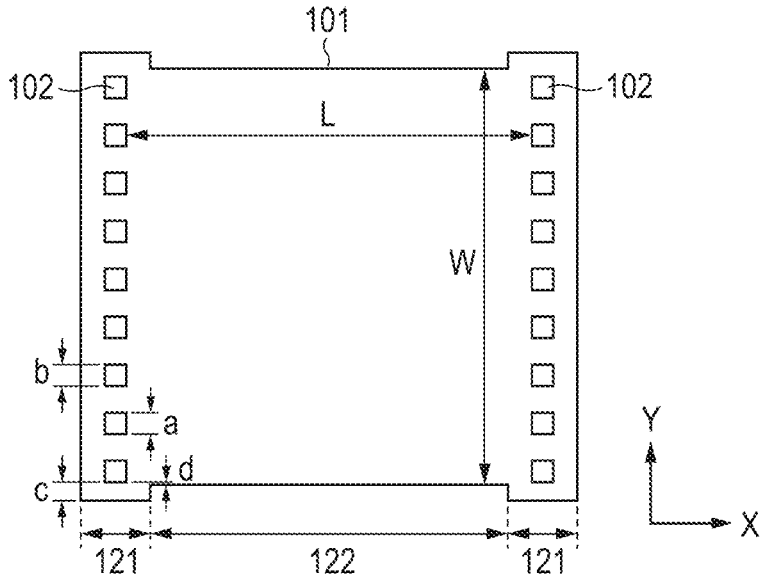
FIG. 5 is a plan view near a heating resistance element according to a third embodiment of the present invention.

FIG. 5 is a plan view near the heating resistance element 101 according to the third embodiment. Similar to the first embodiment, the heating resistance element 101 is divided in the first direction X into the two electrode regions 121 each including the connecting region 110, and the center region 122 positioned between the two electrode regions 121. However, unlike the first embodiment, the two electrode regions 121 are longer than the center region 122 in the second direction Y. The width of the electrode regions 121 in the Y direction may be set independently of the width of the center region 122 in the Y direction. As a result, the connecting members 102 may be arranged in the electrode regions 121 without being subject to the width restriction of the center region 122 in the Y direction, which allows connecting regions 110 that is large in the Y direction to be obtained. According to this embodiment, the current density at the four corners of the heating resistance elements 101 can be increased. Even if deviation occurs in the manufacturing positions of the connecting members 102, the current density at the four corners does not decrease. Further, in this embodiment, more connecting members 102 can be arranged than in the first embodiment or in the second embodiment. As a result, the number of connecting members 102 (resistors) connected in parallel to each other is increased, and a voltage loss of the connecting members 102 is decreased, leading to reduced power consumption.

In this embodiment as well, the plurality of connecting members 102 are positioned so that there is a gap between adjacent connecting members 102 in the second direction Y. In each electrode region 121, the width a of each of the connecting members 102 is essentially the same, each gap b is essentially the same (the connecting members 102 are arranged at equidistant intervals), and each overlap width c of both sides in the Y direction is essentially the same. Further, the width a and the gap b of the connecting members 102, and the overlap width c are essentially the same for the two electrode regions 121 as well. More specifically, in the two electrode regions 121, the connecting members 102 are arranged in a symmetrical shape in the Y direction. The total of the widths of n-number of connecting members 102 in the Y direction is 50% or less of the width of the electrode regions 121 in the Y direction. Similar to the first embodiment, it is desired that the gap b of the connecting members 102 be 1.2 μm or less. The connecting regions 110 are arranged within a range of the center region 122 in the second direction Y. Specifically, the two connecting members 102 positioned at the end portions in the Y direction (hereinafter referred to as end portion connecting members 102*a* and 102*b*) are arranged further inward than peripheral portions of the center region 122. In the other embodiments, a part of the connecting regions 110 may be arranged outside of the range of the center region 122 in the second direction Y. In the following description, a distance between the side of the end portion connecting members 102*a* and 102*b* on the external side and the peripheral portions of the center region 122 (distance that the side of the end portion connecting members 102*a* and 102*b* on the external side is pulled in from the peripheral portions of the center region 122) is referred to as a lead distance d.

Figure 6:
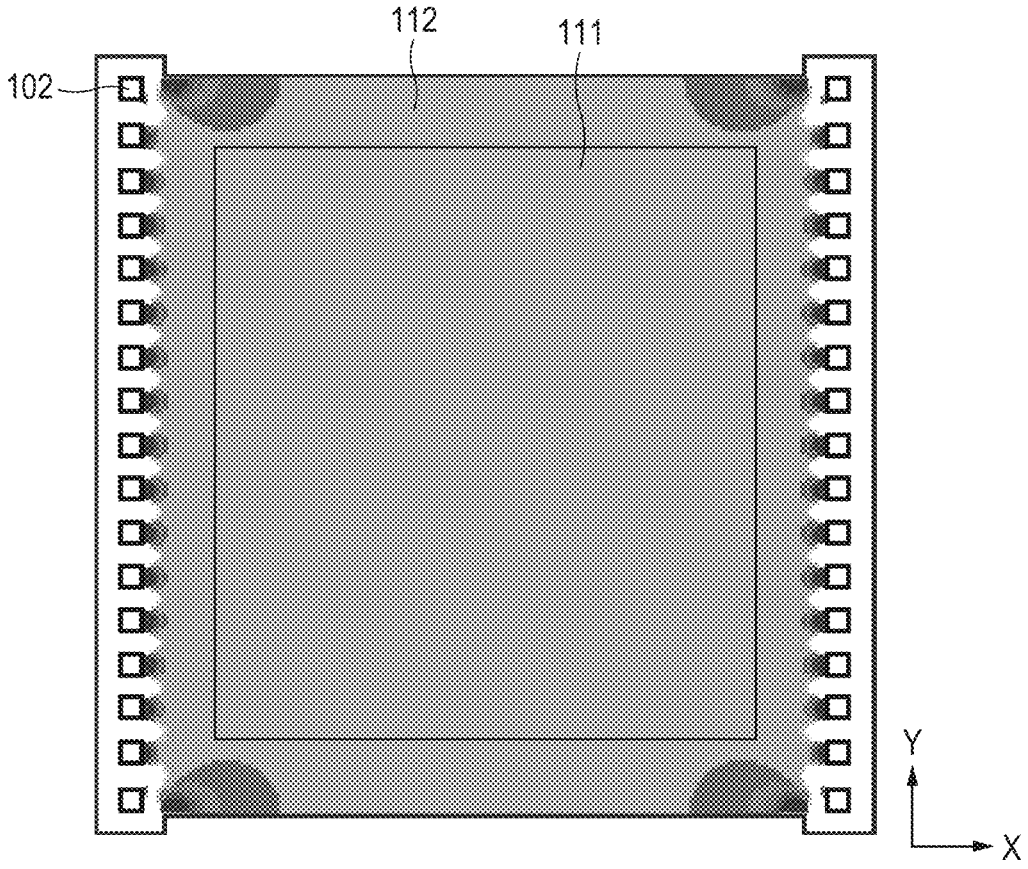
FIG. 6 is a diagram for illustrating an example of a current density distribution of the heating resistance element according to the third embodiment of the present invention.

In FIG. 6, a simulation result of the current distribution according to this embodiment is illustrated. The simulation conditions are the same as in the first embodiment and the second embodiment. The width a of the connecting members 102 is 0.6 μm, the gap b of the connecting members 102 is 0.6 μm, the overlap width c is 0.6 μm, and the lead distance d is 0.1 μm. The width of the electrode regions 121 in the Y direction is larger than in the first embodiment, and hence 17 connecting members 102 are arranged, which is one more than in the first embodiment. The width of the frame region 112 is 2 μm, which is the same as in the first embodiment and the second embodiment. As illustrated in FIG. 6, the width of the electrode regions 121 in the Y direction is wide, and hence a decrease in the current density at the four corners is suppressed.

Figure 7A:
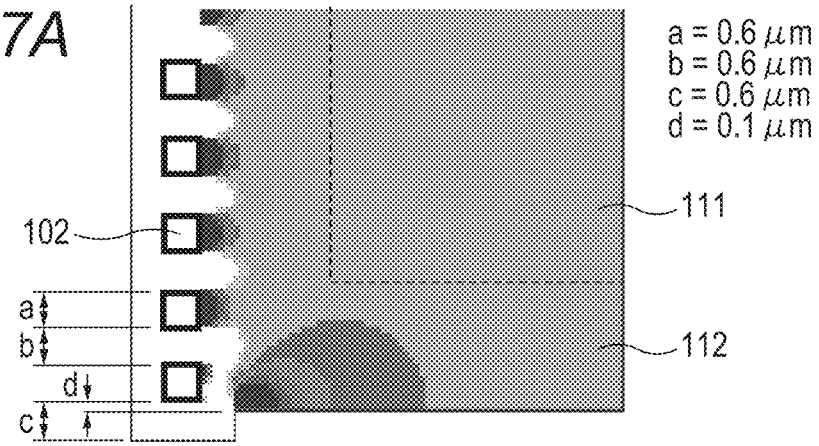
FIG. 7A, FIG. 7B, and FIG. 7C are diagrams for illustrating changes in the current density distribution based on various positions of a connecting member according to the third embodiment of the present invention.
Figure 7B:
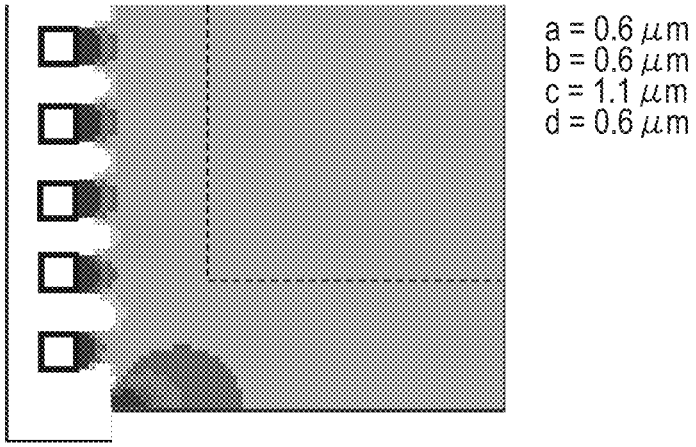
Figure 7C:
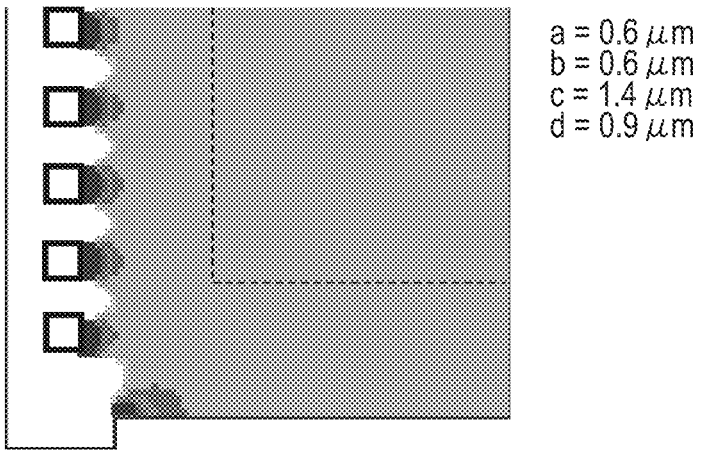
Figure 8:
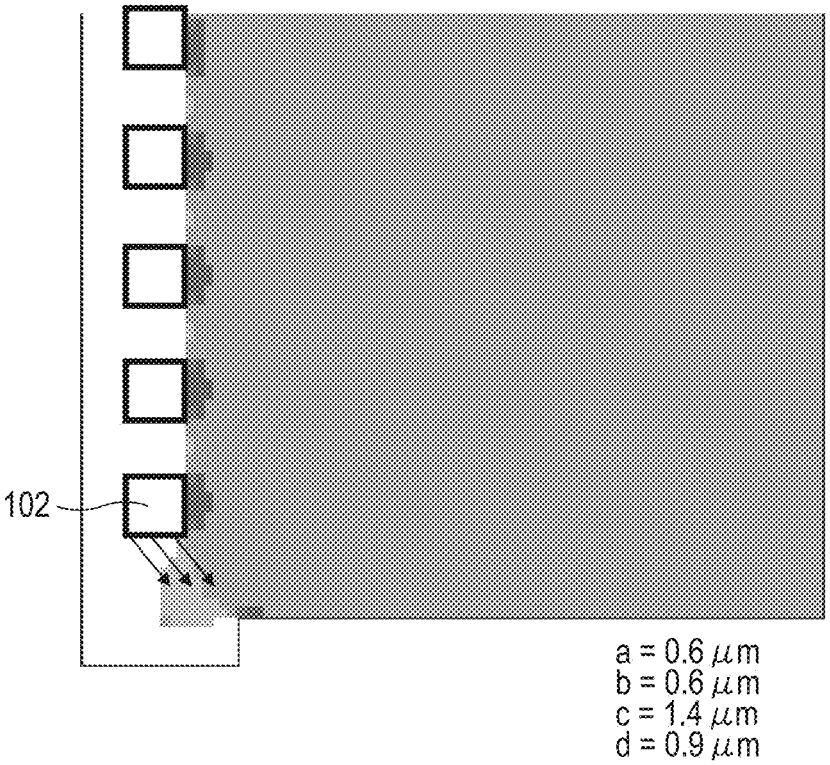
FIG. 8 is an enlarged diagram of a current contour range of FIG. 7C.

In FIG. 7A to FIG. 7C, the current densities at various positions of the connecting members 102 are illustrated. FIG. 7A is an enlarged diagram of a lower left portion of the heating resistance element 101 illustrated in FIG. 6. In FIG. 7B and FIG. 7C, the positions of the end portion connecting members 102*a* and 102*b* are shifted toward the inner side of the heating resistance element 101 from the positions illustrated in FIG. 7A. In the first embodiment, when the positions of the end portion connecting members 102*a* and 102*b* are shifted toward the inner side, the region in which the current is non-uniform widens, but in this embodiment, as illustrated in FIG. 7C, the region in which the current is non-uniform decreases in size. However, when the end portion connecting members 102*a* and 102*b* are shifted by a large amount toward the inner side, the region in which the current is non-uniform widens. Therefore, the lead distance d is preferably 1.2 μm or less, more preferably 0.9 μm or less. FIG. 8 is a diagram in which the contour range of the simulation result in FIG. 7C is widened. As can be seen from FIG. 8, current is flowing through the end portion connecting member 102*a* side. Because the width of the electrode regions 121 in the Y direction is wide, the current flowing from the end portions of the connecting regions 110 to the outside in the Y direction increases, which results in a different current distribution from the first embodiment. Even in this embodiment, the current distribution may be made uniform by widening the connecting regions 110 in the Y direction. However, the region in which the current distribution is non-uniform can be minimized by arranging the connecting members 102 only on the side further inward than the width of the center region 122 in the Y direction. In addition, it is desired that the overlap width c on both sides in the Y direction be larger than the gap b of the connecting members 102, and more commonly, it is desired that the overlap width c on both sides in the Y direction be larger than the average gap of the connecting members 102 in the second direction Y.

Fourth Embodiment

Figure 9:
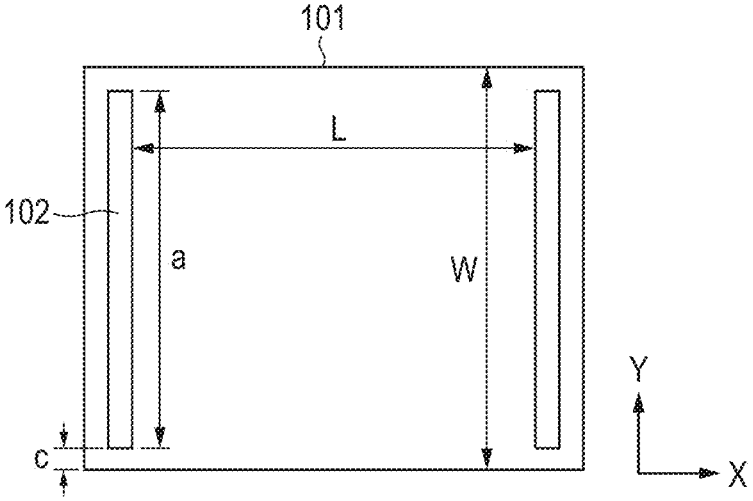
FIG. 9 is a plan view near a heating resistance element according to a fourth embodiment of the present invention.

FIG. 9 is a plan view near the heating resistance element 101 according to a fourth embodiment of the present invention. The two electrode regions 121 and the center region 122 have the same dimension in the second direction Y, and the heating resistance element 101 has a rectangular flat shape. The connecting members 102 are arranged continuously in the second direction Y. In other words, the connecting regions 110 are completely filled with the connecting members 102. The connecting members 102 are formed having a slit-like rectangular shape, which allows the current density in the heating resistance element 101 to be more uniform than in the first embodiment to the third embodiment.

Figure 10:
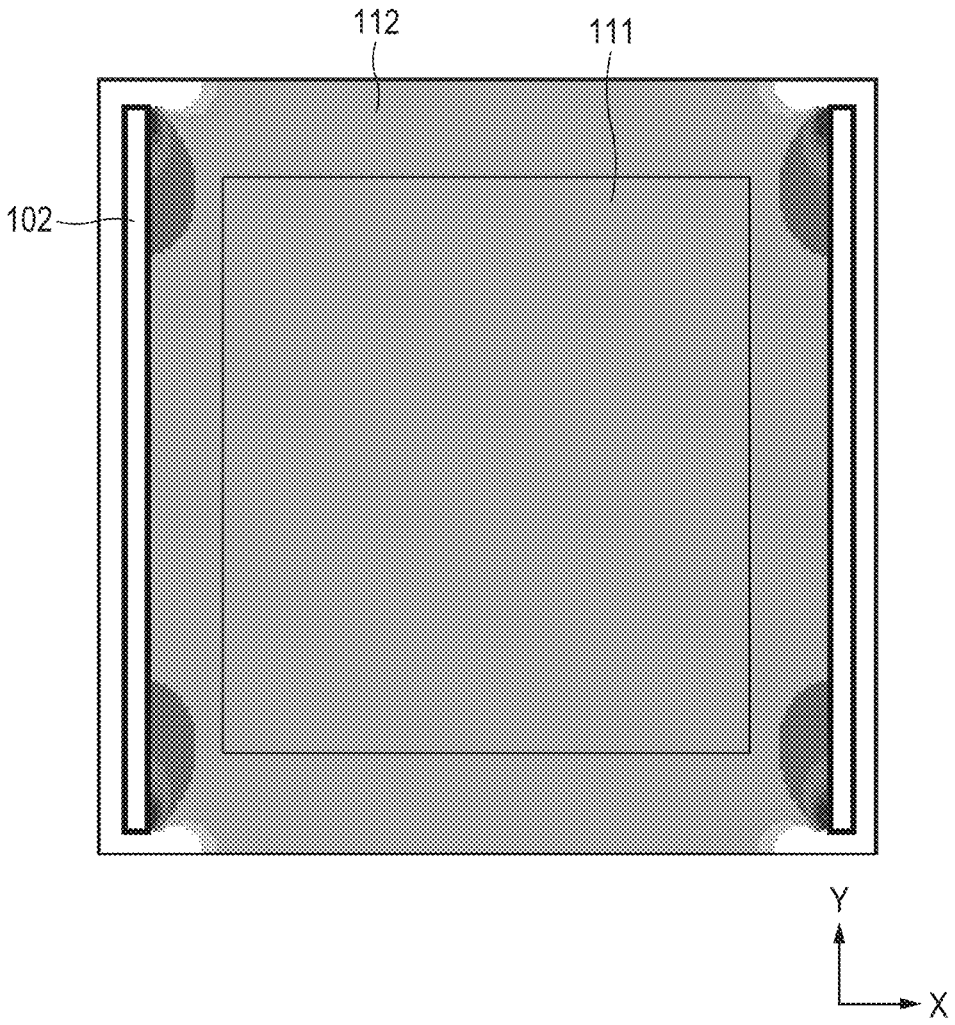
FIG. 10 is a diagram for illustrating an example of a current density distribution of the heating resistance element according to the fourth embodiment of the present invention.

In FIG. 10, a simulation result according to this embodiment is illustrated. In the first embodiment to the third embodiment, the resistance of the connecting members 102 is large because the connecting members 102 are divided in the Y direction. For example, in the simulation result illustrated in FIG. 2, a voltage loss of about 1% occurs for an ideal quadrilateral-shaped heating resistance element 101 (in which current flows uniformly through the entire width of the heating resistance element 101). In contrast, in the simulation result illustrated in FIG. 10, the voltage loss is 0.1% or less, which means that energy can be applied to the heating resistance element 101 with hardly any voltage loss. Thus, in this embodiment, except for the end portions of the connecting members 102, the current distribution is uniform, and an ideal configuration of the heating resistance element 101 can be obtained.

Figure 11A:
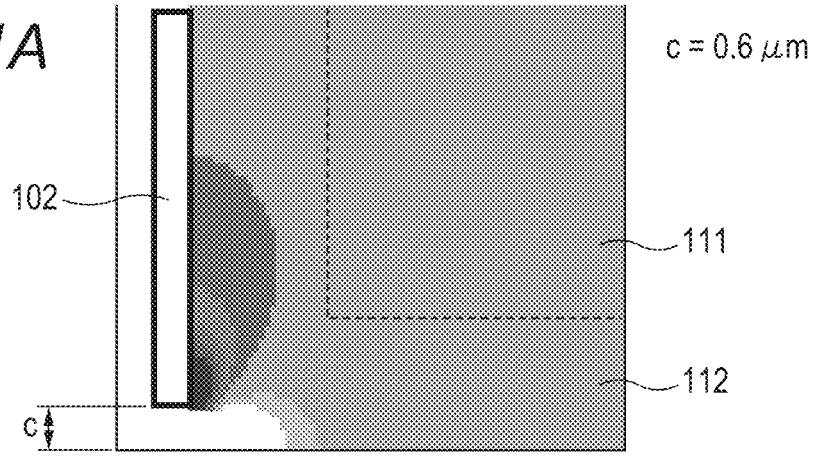
FIG. 11A and FIG. 11B are diagrams for illustrating changes in the current density distribution based on various positions of a connecting member according to the fourth embodiment of the present invention.
Figure 11B:
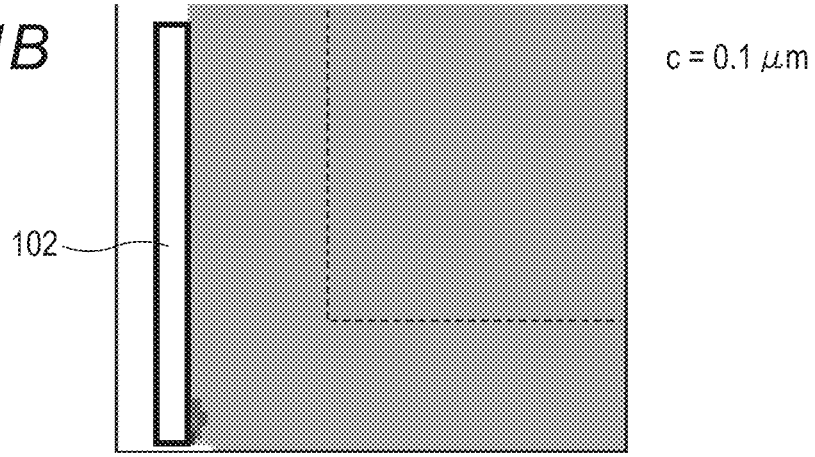

In FIG. 11A and FIG. 11B, simulation results when the end portion positions of the connecting members 102 have been shifted are illustrated. In FIG. 11A, the lower left portion of the heating resistance element 101 illustrated in FIG. 10 is enlarged. In FIG. 11B, the end portion positions of the connecting members 102 illustrated in FIG. 10 have been shifted in the Y direction (the width of the connecting members 102 in the Y direction has changed). In FIG. 11A, the overlap width c is 0.6 μm, and in FIG. 11B, the overlap width c is 0.1 μm. In the case of a rectangular heating resistance element 101, as the overlap width c becomes smaller and smaller, the region in which the current is non-uniform becomes less and less, and the current distribution is more ideal.

Fifth Embodiment

Figure 12:
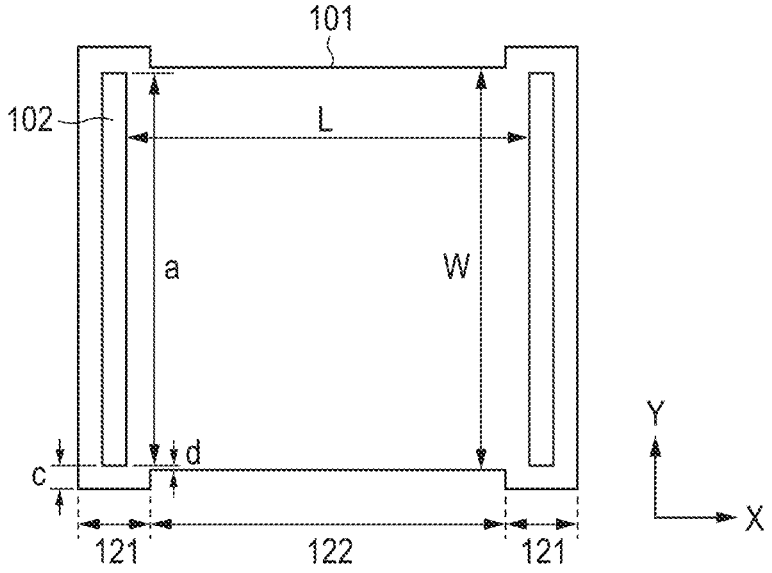
FIG. 12 is a plan view near a heating resistance element according to a fifth embodiment of the present invention.
Figure 13:
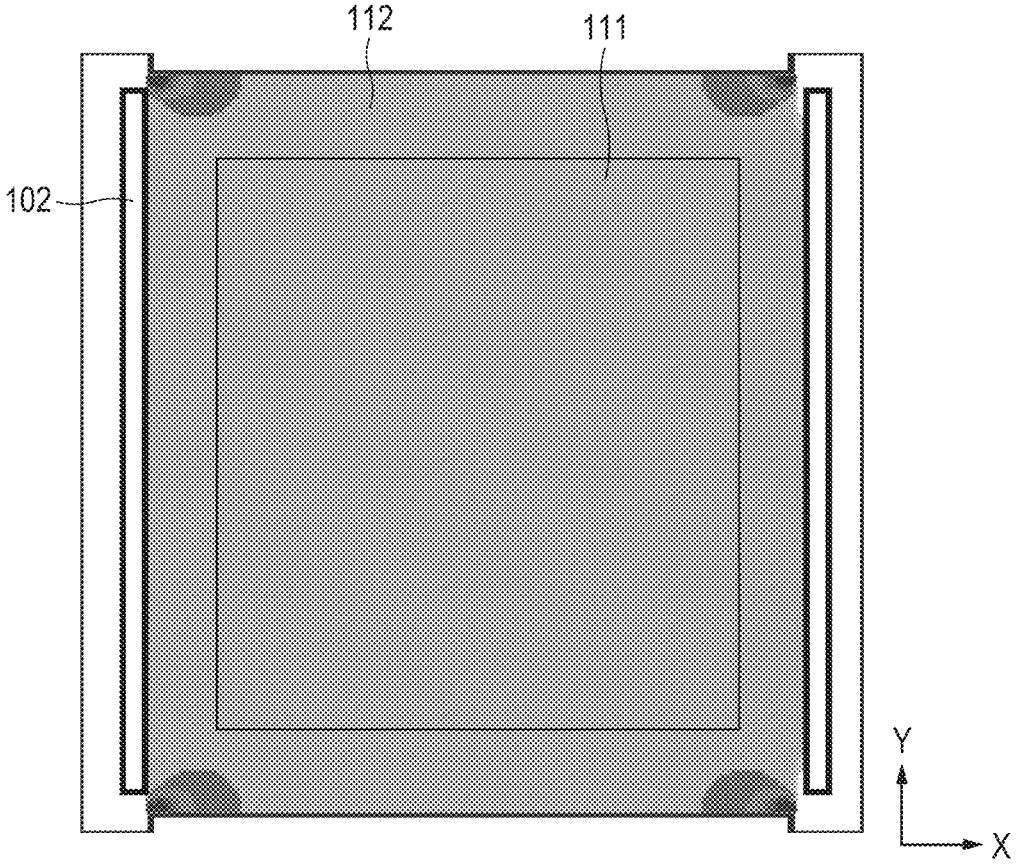
FIG. 13 is a diagram for illustrating an example of a current density distribution of the heating resistance element according to the fifth embodiment of the present invention.

FIG. 12 is a plan view near the heating resistance element 101 according to a fifth embodiment of the present invention. The two electrode regions 121 and the center region 122 have different dimensions in the second direction Y, and the shape of the heating resistance element 101 is the same as in the third embodiment. The connecting members 102 are arranged continuously in the second direction Y. The shape of the connecting members 102 is the same as in the fourth embodiment. Therefore, similar to the fourth embodiment, the voltage loss of the connecting members 102 is very small. In this embodiment as well, forming the connecting members 102 in a slit-like rectangular shape allows the current density of the heating resistance element 101 to be more uniform than in the first embodiment to the third embodiment. In FIG. 13, a simulation result according to this embodiment is illustrated. Similar to the fourth embodiment, the voltage loss is 0.1% or less, which means that energy can be applied to the heating resistance element 101 with hardly any voltage loss. In this embodiment as well, except for the end portions of the connecting members 102, the current distribution is uniform, and an ideal configuration of the heating resistance element 101 can be obtained.

Figure 14A:
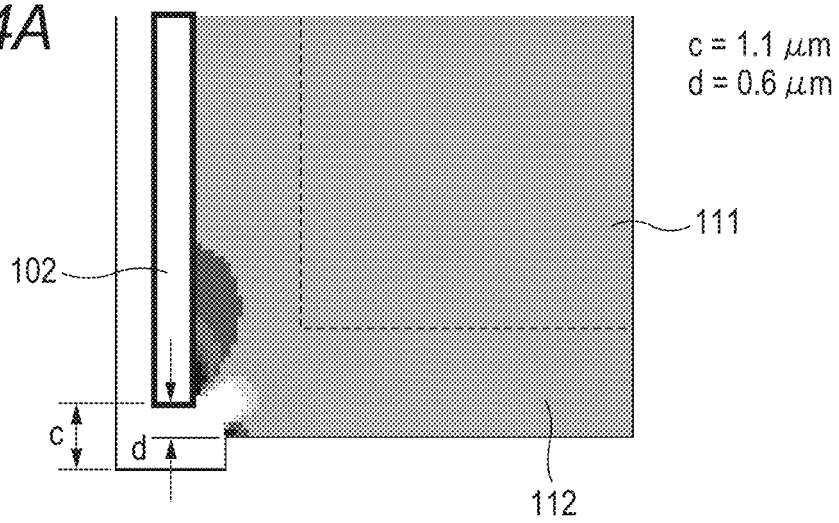
FIG. 14A, FIG. 14B, and FIG. 14C are diagrams for illustrating changes in the current density distribution based on various positions of a connecting member according to the fifth embodiment of the present invention.
Figure 14B:
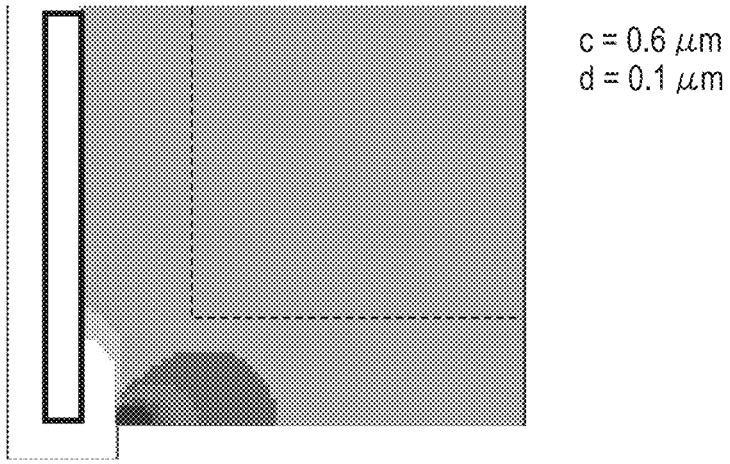
Figure 14C:
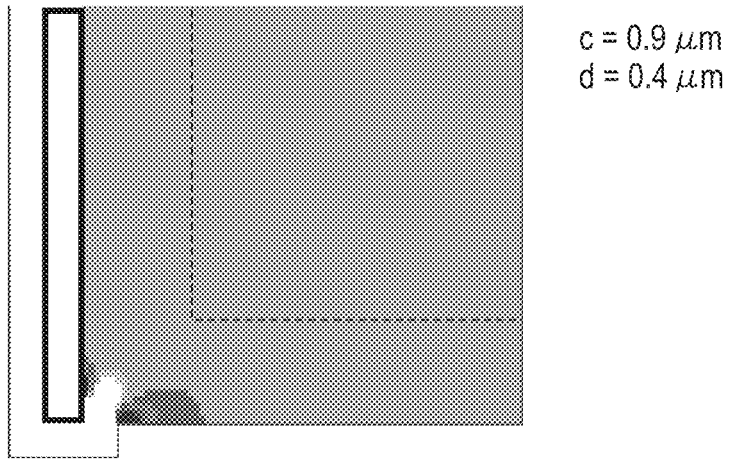

In FIG. 14A to FIG. 14C, simulation results when the end portion positions of the connecting members 102 have been shifted are illustrated. In FIG. 14A, the lower left portion of the heating resistance element 101 illustrated in FIG. 13 is enlarged. In FIG. 14B and FIG. 14C, the end portion positions of the connecting members 102 illustrated in FIG. 13 have been shifted in the Y direction (the width of the connecting members 102 in the Y direction has changed). In FIG. 14A, the overlap width c is 1.1 μm and the lead distance d is 0.6 μm. In FIG. 14B, the overlap width c is 0.6 μm and the lead distance d is 0.1 μm. In FIG. 14C, the overlap width c is 0.9 μm and the lead distance d is 0.4 μm. From FIG. 14A and FIG. 14B, it can be seen that in the case of the heating resistance element 101 in which the electrode regions 121 are wider than the center region 122, when the overlap width c is reduced, the region in which the current is non-uniform conversely increases in size. Similar to the principles discussed in the third embodiment, this is due to the current coming around from the end portions of the connecting members 102. In the case of the shape of the heating resistance element according to this embodiment, it is preferred to set the overlap width c and the lead distance d to have a certain dimension in order to obtain a uniform current density distribution. The region in which the current is non-uniform is minimized when c in FIG. 14C is 0.9 μm and d in FIG. 14C is 0.4 μm. It is preferred that the lead distance d be 0.6 μm or less.

Various simulation results are shown in the above-mentioned embodiments. However, the relative positions of the actual heating resistance elements 101 and the connecting members 102 may be different from the simulation results depending on manufacturing accuracy and unevenness. The optimum values or the preferred values of the width a and the gap b of the connecting members 102, the overlap width c, and the lead distance d shown in the simulation results may vary in a range of about ±0.1 μm. For example, in the above-mentioned fifth embodiment, the optimum range of the overlap width c that minimizes the region in which the current is non-uniform is from 0.8 μm or more to 1.0 μm or less, and the optimum range of the lead distance d is from 0.3 μm or more to 0.5 μm or less.

Sixth Embodiment

Figure 16A:
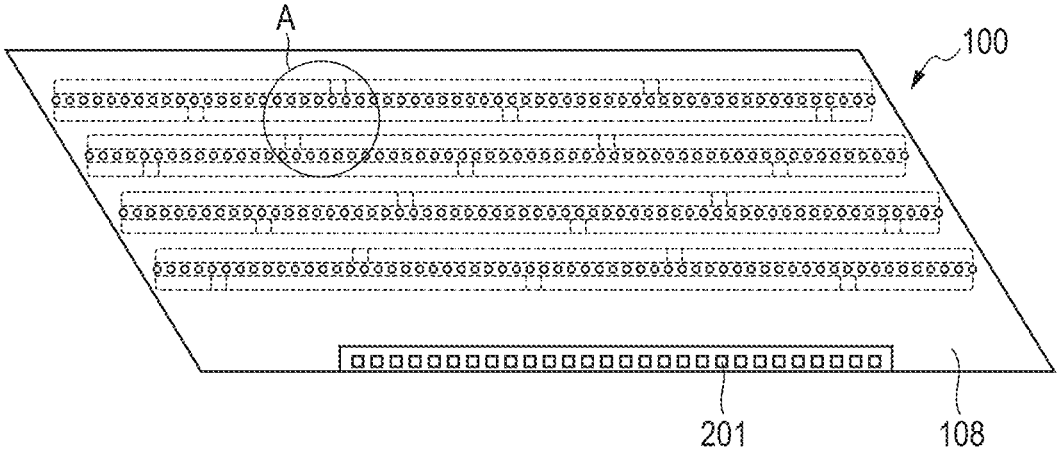
FIG. 16A is a plan view of an element substrate according to a sixth embodiment of the present invention.
Figure 16B:
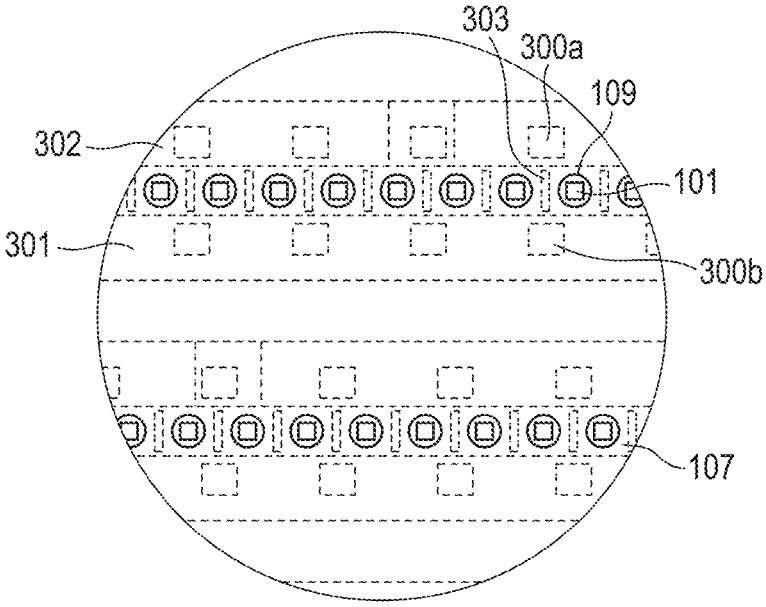
FIG. 16B is an enlarged view of the portion A illustrated in FIG. 16A.

In FIG. 16A and FIG. 16B, a configuration of an element substrate 100 according to a sixth embodiment of the present invention is illustrated. FIG. 16A is a plan view of the surface of the element substrate 100 in which the ejection orifices 109 are formed. FIG. 16B is an enlarged view of the portion A illustrated in FIG. 16A. The outer periphery of the element substrate 100 according to this embodiment is shaped roughly like a parallelogram. In the ejection orifice forming member 108 of the element substrate 100, four lines of ejection orifices corresponding to cyan, magenta, yellow, and black (CMYK), respectively, are formed in two dimensions. Note that, in the following description, the direction that the ejection orifice lines in which the plurality of ejection orifices 109 are arranged extend is referred to as an "ejection orifice line direction".

As illustrated in FIG. 16B, recording elements 101, which are heating resistance elements for causing a liquid to be foamed by heat energy, are arranged at positions corresponding to the ejection orifices 109, respectively. The pressure chambers 107, which include the recording elements 101, are partitioned by a partition 303. The recording elements 101 are electrically connected to the electrode pads 201 illustrated in FIG. 16A by electrical wirings 103*c* and 103*d* (refer to FIG. 1B) arranged in the element substrate 100. The recording elements 101 are configured to cause the liquid to boil by generating heat based on a pulse signal input from a control circuit of a recording device (not shown). The liquid is ejected from the ejection orifices 109 by the force of the air bubbles produced by this boiling. As illustrated in FIG. 16B, in the ejection orifice line direction, a liquid supply channel 301 is extended on one side of each ejection orifice line, and a liquid recovery channel 302 is extended on another side. The liquid supply channel 301 and the liquid recovery channel 302 are flow channels that are arranged on the base material 113 of the element substrate 100 and are configured to extend in the ejection orifice line direction. The liquid supply channel 301 and the liquid recovery channel 302 are both in communication with the ejection orifices 109 via a supply port 300*a* and a recovery port 300*b*, respectively. The supply port 300*a* and the recovery port 300*b* are through holes passing through the substrate 114 of the element substrate 100 (refer to FIG. 1B). Based on this channel configuration, the liquid flowing through the liquid supply channel 301 is supplied to the recording elements 101 via a plurality of supply ports 300*a*, and ejected from the ejection orifices 109. Of the liquid supplied to the recording elements 101, liquid that has not been ejected is recovered in the liquid recovery channel 302 via a plurality of recovery ports 300*b*. The liquid recovered in the liquid recovery channel 302 is again supplied to the liquid ejection head via a tank portion arranged in the recording device. The liquid travels this flow route to be circulated. However, the present invention is not limited to the circulation configuration described in this embodiment. For example, the liquid may be supplied to the recording elements 101 from the liquid recovery channel 302 via the recovery ports 300*b*. Such a configuration is preferred, as this configuration allows the liquid to be supplied to the recording elements 101 from openings (300*a* and 300*b*) formed on both sides of the recording elements 101, enables ejection symmetry to be obtained, and also allows refilling after ejection of the liquid to be performed comparatively quickly.

In an element substrate 100 such as that in this embodiment, which includes a plurality of ejection orifice lines (lines of the recording elements 101) and a plurality of liquid openings (e.g., supply port 300*a* and recovery port 300*b*), which pass through the substrate 114, the multi-layer wiring configuration illustrated in FIG. 1B is especially preferred. In such a configuration in which the recording elements 101 are two-dimensionally arranged, an element substrate 100 that suppresses an increase in the size of the substrate can be obtained by using the multi-layer wiring of the electrical wirings 103*a* and 103*b* and through hole configuration.

Further, arranging a plurality of the element substrates 100 enables a line-type liquid ejection head having a length corresponding to the width of the recording medium to be provided. In particular, by forming the outer periphery of the element substrates 100 roughly like a parallelogram, and arranging the plurality of element substrates 100 in a straight line (in-line) as in this embodiment, a compact line-type liquid ejection head that has a suppressed length in the short direction can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-013197, filed Jan. 27, 2015, and Japanese Patent Application No. 2015-233689, filed Nov. 30, 2015, which are hereby incorporated by reference herein in their entirety.

What is claimed is:

1. An element substrate of a liquid ejection head comprising:

a base material;

an insulating film positioned on the base material;

a heating resistance element positioned on the insulating film;

a protective film covering the heating resistance element;

an electrical wiring layer, which is arranged in the insulating film, and is configured to supply a current to the heating resistance element; and at least one first electrical connecting member and at least one second electrical connecting member which extend into the insulating film to connect a surface of the insulating film side of the heating resistance element and a surface of the heating resistance element side of the electrical wiring layer, the at least one first electrical connecting member and the at least one second electrical connecting member being positioned separately in a first direction, wherein the heating resistance element comprises a first electrical connecting region to connect the at least one first electrical connecting member and a second electrical connecting region to connect the at least one second electrical connecting member, the first electrical connecting region and the second electrical connecting region extending in a second direction intersecting the first direction in a plane view of the element substrate, wherein the second direction is a direction along a longitudinal direction of the element substrate, wherein in the plane view of the element substrate, in a region of partial overlap between the heating resistance element and the electrical wiring layer, the at least one first electrical connecting member and the at least one second electrical connecting member are extended in the insulating film to connect the heating resistance element to the electrical wiring layer, wherein the heating resistance element comprises a foaming region, which is arranged between the first electrical connecting region and the second electrical connecting region, and in which the liquid is foamed, and wherein the first electrical connecting region and the second electrical connecting region extend across a range including an entire length of the foaming region in the second direction.

2. The element substrate of a liquid ejection head according to claim 1, wherein an abutting surface of the at least one first electrical connecting member and the at least one second electrical connecting member with the heating resistance element and an abutting surface of the insulating film with the heating resistance element are arranged in the same plane.

3. The element substrate of a liquid ejection head according to claim 1, wherein a length of the first electrical connecting region in the second direction is longer than a length of the first electrical connecting region in the first direction, and a length of the second electrical connecting in the second direction is longer than a length of the second electrical connecting region in the first direction.

4. The element substrate of a liquid ejection head according to claim 1, wherein a plurality of the first electrical connecting members are positioned in the second direction with a gap between adjacent first electrical connecting members, and a plurality of the second electrical connecting members are positioned in the second direction with a gap between adjacent second electrical connecting members.

5. The element substrate of a liquid ejection head according to claim 1, wherein both end portions of the first electrical connecting region in the second direction are separated by the same distance from a peripheral portion of the heating resistance element in the second direction, and both end portions of the second electrical connecting region in the second direction are separated by the same distance from a peripheral portion of the heating resistance element in the second direction.

6. The element substrate of a liquid ejection head according to claim 1, wherein the heating resistance element is divided into, in the first direction, a first electrode region comprising the at least one first electrical connecting member, a second electrode region comprising the at least one second electrical connecting member, and a center region positioned between the first electrode region and second electrode region and wherein the first electrode region, the second electrode region and the center region have the same dimension in the second direction.

7. The element substrate of a liquid ejection head according to claim 1, wherein the at least one first electrical connecting member is continuously arranged in the second direction and the at least one second electrical connecting member is continuously arranged in the second direction.

8. The element substrate of a liquid ejection head according to claim 1, wherein the electrical wiring layer comprises a first electrical wiring layer and a second electrical wiring layer on a different layer from the first electrical wiring layer, and the element substrate further comprises, on a layer different from the first electrical wiring layer and the second electrical wiring layer in the insulating film, a third electrical wiring layer comprising a logic power supply wiring for driving the heating resistance element.

9. The element substrate of a liquid ejection head according to claim 8, wherein the first electrical wiring layer and the second electrical wiring layer are arranged on a side closer to the heating resistance element than the third electrical wiring layer.

10. The element substrate of a liquid ejection head according to claim 8, wherein a thickness of the first electrical wiring layer and a thickness of the second electrical wiring layer are larger than a thickness of the third electrical wiring layer.

11. The element substrate of a liquid ejection head according to claim 1, wherein the electrical wiring layer comprises a first electrical wiring layer and a second electrical wiring layer on a different layer from the first electrical wiring layer, and the element substrate further comprises, on a layer different from the first electrical wiring layer and the second electrical wiring layer in the insulating film, a fourth electrical wiring layer comprising a signal wiring for driving the heating resistance element.

12. The element substrate of a liquid ejection head according to claim 11, wherein the first electrical wiring layer and the second electrical wiring layer are arranged on a side closer to the heating resistance element than the fourth electrical wiring layer.

13. The element substrate of a liquid ejection head according to claim 1, wherein an outer periphery of the element substrate is shaped roughly like a parallelogram.

14. The element substrate of a liquid ejection head according to claim 1, further comprising a plurality of heating resistance elements being arranged along the second direction and a plurality of supply ports being arranged along the second direction to supply a liquid to the heating resistance elements.

15. The element substrate of a liquid ejection head according to claim 1, further comprising a supply port for supplying a liquid to the heating resistance element and a recovery port for recovering a liquid supplied, wherein a liquid is circulated via the supply port and the recovery port.

16. The element substrate of a liquid ejection head according to claim 1, wherein a current flows in the heating resistance element along the first direction.

17. The element substrate of a liquid ejection head according to claim 1, wherein a first portion of the electrical wiring layer connected with the first electrical connecting member and a second portion of the electrical wiring layer connected with the second electrical connecting member are separated in the first direction.

18. The element substrate of a liquid ejection head according to claim 1, further comprising an aluminum layer arranged in the insulating film between the first electrical connecting region and the second electrical connecting region.

19. A line-type liquid ejection head comprising:

a plurality of element substrates of the liquid ejection head according to claim 1 arranged along a straight line.

* * * * *